US008139812B2

(12) United States Patent
Basnet et al.

(10) Patent No.: US 8,139,812 B2
(45) Date of Patent: Mar. 20, 2012

(54) LOUDSPEAKER SUSPENSION

(76) Inventors: Subarna Basnet, Natick, MA (US); Mark P. Temple, Bolton, MA (US)

( * ) Notice: Subject to any disclaimer, the term of this patent is extended or adjusted under 35 U.S.C. 154(b) by 1027 days.

(21) Appl. No.: 12/057,889

(22) Filed: Mar. 28, 2008

(65) Prior Publication Data

US 2008/0212822 A1 Sep. 4, 2008

Related U.S. Application Data

(63) Continuation-in-part of application No. 10/993,996, filed on Nov. 19, 2004, now Pat. No. 7,397,927.

(51) Int. Cl.
*H04R 1/00* (2006.01)
*H04R 7/00* (2006.01)

(52) U.S. Cl. ..... 381/398; 181/171

(58) Field of Classification Search ..... 381/398; 181/171, 172, 173, 174
See application file for complete search history.

(56) References Cited

U.S. PATENT DOCUMENTS

| | | | | |
|---|---|---|---|---|
| 1,734,624 | A | 11/1929 | Harrison | |
| 1,891,566 | A | 12/1932 | McKellip | |
| 2,302,178 | A | 11/1942 | Brennan | |
| 2,439,665 | A | 4/1948 | Marquis | |
| 3,563,337 | A | 2/1971 | Kawamura | |
| 3,997,023 | A | 12/1976 | White | |
| 4,321,434 | A | 3/1982 | Irie | |
| 4,324,312 | A | 4/1982 | Durbin | |
| 4,433,214 | A | 2/1984 | Jasinski | |
| 4,881,617 | A | 11/1989 | Faraone | |
| 5,371,805 | A * | 12/1994 | Saiki et al. | 381/398 |
| 5,903,656 | A | 5/1999 | D'Hoogh et al. | |
| 6,305,491 | B2 * | 10/2001 | Iwasa et al. | 181/172 |
| 6,449,375 | B1 | 9/2002 | Hutt | |
| 6,567,528 | B1 | 5/2003 | Heed | |
| 6,697,496 | B2 * | 2/2004 | Frasl | 381/398 |
| 6,725,967 | B2 | 4/2004 | Hibowicki | |
| 6,851,513 | B2 | 2/2005 | Stead et al. | |
| 6,957,714 | B2 * | 10/2005 | Takahashi et al. | 181/171 |
| 7,054,459 | B2 * | 5/2006 | Kuze et al. | 381/398 |
| 7,397,927 | B2 | 7/2008 | Pircaro et al. | |
| 2002/0144859 | A1 | 10/2002 | Pocock et al. | |
| 2002/0170773 | A1 | 11/2002 | Stead et al. | |
| 2003/0070869 | A1 | 4/2003 | Hlibowicki | |
| 2003/0231784 | A1 | 12/2003 | Kuze et al. | |
| 2006/0070796 | A1 * | 4/2006 | Frasl | 181/173 |
| 2006/0110002 | A1 | 5/2006 | Pircaro et al. | |
| 2007/0071275 | A1 | 3/2007 | Matsuda et al. | |

FOREIGN PATENT DOCUMENTS

CN 1458806 A 11/2003

(Continued)

OTHER PUBLICATIONS

CN Office Action dated Oct. 13, 2010 for CN Appln. No. 200510126721.8.

(Continued)

*Primary Examiner* — Brian Ensey
(74) *Attorney, Agent, or Firm* — Bose Corporation

(57) ABSTRACT

Disclosed is a loudspeaker suspension structure having asymmetrical grooves. In an aspect, an apparatus includes a loudspeaker suspension structure having grooves, each extending from an inner circumferential border, to an outer circumferential border, at least one groove having a groove depth that varies asymmetrically from the inner circumferential border to the outer circumferential border.

34 Claims, 14 Drawing Sheets

FOREIGN PATENT DOCUMENTS

| | | | | |
|---|---|---|---|---|
| EP | 1 381 251 | | | 1/2004 |
| EP | 1517582 | A1 | | 3/2005 |
| EP | 1659823 | A2 | | 5/2006 |
| GB | 726 780 | | | 3/1955 |
| GB | 1 478 371 | | | 6/1977 |
| JP | 51035128 | | | 3/1976 |
| JP | 53131333 | | | 11/1978 |
| JP | 55121593 | | | 9/1980 |
| JP | 57204792 | | | 12/1982 |
| JP | 59111389 | U | | 12/1982 |
| JP | 58127499 | | | 7/1983 |
| JP | 58127499 | A | * | 7/1983 |
| JP | 59050698 | A | | 3/1984 |
| JP | 60027299 | | | 2/1985 |
| JP | 60027299 | A | | 2/1985 |
| JP | 61276499 | | | 12/1986 |
| JP | 61276499 | A | | 12/1986 |
| JP | 6126499 | A | | 5/1994 |
| JP | 2007282012 | A | | 10/2007 |

OTHER PUBLICATIONS

JP Office Action dated Jun. 7, 2011 for JP Appln. No. 2005-334946.
CN Office Action dated May 11, 2011 for CN Appln. No. 200510126721.8.
EP Office Action dated Jul. 3, 2006 for EP Appln. No. 05110837.1.
EP Office Action dated Sep. 18, 2007 for EP Appln. No. 05110837.1.
EP Office Action dated Feb. 13, 2008 for EP Appln. No. 05110837.1.
International Search Report and Written Opinion dated Jul. 29, 2009 for PCT/US2009/036932.
"Audio Engineering Handbook, p. 7.32, Copyright 1988 by McGraw-Hill, Inc."
International Preliminary Report on Patentability dated Jun. 9, 2010 for PCT/US2009/036932.
18 Sound Model 6ND430, (downloaded May 23, 2007) http://www.eighteensound.it/index.aspx?mainMenu=view_product&pid=243.
Audio Engineering Handbook, p. 7.32, Copyright 1988 by McGraw-Hill, Inc.
AudioVideo International, Jan. 1999, Pioneer Elite TZF700 Speaker System, CES 1999, p. 124.
Better Listening Through Chemistry, YAMAHA Advertisement, Yamaha Electronics Corporation, USA, P.O. Box 6660, Buena Park, CA 90622, Stereo Review, Oct. 1982.
Bravox uxs8 woofer, (downloaded May 23, 2007) http://www.bravoxaudio.corm/uxs.asp.
Foster Models 334495, 334459, 056117, 334496, 060588, (downloaded May 23, 2007) http://www.foster.co.jp/en_products/microspeakers/index.html.
Fostex NF-7 Technical White Paper, Sep. 1998.
Hasegawa, et al., SAE Technical Paper Series—850162, 3-D Loud-Speaker Systems for Automotive Use, International Congress & Exposition, Detroit, Michigan, Feb. 25-Mar. 1, 1985.
How to Reap the Rewards of Higher Fidelity, Altec Advertisement, Altec Lansing Consumer Products, Milford, PA, Audio Video International, Jun. 1986.
http://www.lautsprechershop.de/hifi/visaton_mt.htm, Visaton Chassis, DSM50FFL, downloaded Apr. 11, 2007.
Hygeia FT2591, (downloaded May 23, 2007) http://www.hg-audio.com.tw/en_products.html.
Kicker CompVR Woofer Technical Manual, Version 2.1, Apr. 23, 2002, pp. 2-34, p. 4.
Pyramid Product Catalog, 2002, p. 38.
Sony MHC-RX88, What Hi-Fi?, p. 103, Published Sep. 23, 1998.
Stetron Low Profile Speaker, (downloaded May 23, 2007) http://www.stetron.com/speakers/pdf/Low%20Profile%20Speakers.pdf.
Toptone Speakers Catalogue, Specification of Part No. F52A32-1, p. 7, Tokyo Cone Paper Mfg. Co., Ltd, 87 Niigatafukuro Kasukabe-City Saitama-Pref, 344-0056, Japan.
Visaton DSM 50 FFL 8 OHM, (downloaded May 23, 2007) , http://www.visaton.com/en/chassis_zubehoer/mt_kalotten/dsm50ffl_8.html.
European Search Report dated May 22, 2006 from European Application No. 05110837.1.
Examination Report dated Sep. 18, 2007 from European Application No. 05110837.1.
Action and Response History retrieved for U.S. Appl. No. 10/993,996, through Jun. 19, 2008.

* cited by examiner

LOUDSPEAKER SUSPENSION

CLAIM OF PRIORITY

This application is a continuation-in-part of U.S. Utility patent application Ser. No. 10/993,996, filed Nov. 19, 2004, the entire contents of which is hereby incorporated by reference.

BACKGROUND

This description relates to loudspeaker suspensions.

Referring to FIG. 1, a typical loudspeaker 14 includes a stiff cone 15 connected to a voice coil 20 at the apex of the cone. The loudspeaker 14 includes a dust cap 23 attached to the cone 15. The voice coil 20 interacts with the magnetic circuit formed from permanent magnet 25, back plate/pole piece structure 30, and top plate 21. When the voice coil is driven by an audio signal, the cone 15 vibrates axially to produce sound.

An outer edge 40 of the cone 15 is attached to a rigid basket 45 along an annular mounting flange 47 by suspension element 50, typically referred to as a surround. The voice coil 20 and/or apex of cone 15 may be attached to another section of the rigid basket 45 by second suspension element 35, typically referred to as a spider. The surround 50 is often made from a flexible material such as fabric, that allows the cone 15 to vibrate but provides a restoring force to aid in restoring the cone 15 to an at-rest position, when the voice coil 20 is not being driven. The spider 35 is typically a circular woven cloth part with concentric corrugations. The suspension elements 35, 50 provide a restoring force, along the axial direction, and a centering force, along the radial direction, for the cone 15. In many examples, single or multiple surrounds and/or spiders are used as suspension elements 35, 50.

Referring now to FIGS. 2 and 3, the prior art surround 50 can be seen to be a hollow semi-toroid about a center O with an inner circumferential edge 60 and an outer circumferential edge 55. As shown in FIG. 3, a cross-section taken along line A-A in FIG. 2 traces a semi-circular shape or a dome shape. In response to an axial force 58 on the cone 15, a point P on the surround 50 moves, for example, along a locus 59 defined by points $P_2$-P-$P_1$.

FIG. 4 shows a plan view of an alternative prior art surround 70. The surround 70 has grooves 65 extending outward at an angle to the radial direction, over the majority of the width from the inner to the outer circumferential edges of the surround.

FIG. 5 shows a circumferential section along line B-B of FIG. 3. Each groove can be a V-shaped trough D at the bottom and corners E, F at the top.

SUMMARY

Disclosed is a loudspeaker suspension structure having asymmetrical grooves.

In one aspect, an apparatus includes a loudspeaker suspension structure having grooves, each extending from an inner circumferential border, to an outer circumferential border, at least one groove having a groove depth that varies asymmetrically from the inner circumferential border to the outer circumferential border.

The following are examples within the scope of this aspect.

The at least one groove has at least two substantially different groove depths. The at least one groove has a first groove depth substantially near the inner circumferential border, and a second groove depth substantially near the outer circumferential border. The first groove depth is substantially greater than the second groove depth. The grooves are oriented at an angle with respect to a normal to the inner circumferential border.

The grooves span only a portion of the distance between the inner circumferential border and the outer circumferential border. A profile of a circumferential section of the suspension structure has a continuous curvature. The continuous curvature includes a series of peaks and dips and the radius of curvature of each of the peaks is greater than the radiuses of curvature of the adjacent dips. The continuous curvature includes a series of peaks and dips and the radius of curvature of at least a portion of each of the peaks is less than the radiuses of curvature of the adjacent dips. The suspension structure comprises a fractional portion of a toroid.

The suspension structure conforms to a rolled shape. The rolled shape is rolled up. The rolled shape is rolled down. The rolled shape comprises two or more rolls between the inner circumferential border and the outer circumferential border. The grooves have varying groove depths along a circumference of the suspension structure. The grooves are spaced irregularly along a circumference of the suspension structure. The grooves are straight in plan view.

An angle of the grooves in plan view is in the range of 10 to 90 degrees. Each of the grooves comprises a curve in plan view. The curve begins at an angle to the normal to the inner circumferential border or the outer circumferential border. The curve comprises sections.

The sections comprise straight sections. The sections comprise curved sections. The sections have respectively different angles with respect to a normal to the inner circumferential border. The sections also comprises transition sections that smoothly join the straight or curved sections. A bottom of a groove comprises of a plurality of portions, each portion having a substantially different radius of curvature. The grooves are located in different convolutions of the suspension structure. The suspension structure comprises a surround. The suspension structure comprises a spider.

In another aspect, an apparatus includes a loudspeaker suspension structure having an inner circumferential border, and an outer circumferential border, and grooves, each having a first groove depth substantially near the inner circumferential border and a second groove depth substantially near the outer circumferential border, the first groove depth being different from the second groove depth.

In an example within the scope of this aspect, each of the grooves extend from the inner circumferential border to the outer circumferential border.

In another aspect, an apparatus includes a loudspeaker suspension structure having an inner circumferential border, and an outer circumferential border, and at least one groove having a groove depth that varies asymmetrically along the length of the groove, a first end of the groove being at a first predetermined distance from the inner circumferential border, and a second end of the groove being at a second predetermined distance from the outer circumferential border.

In an example within the scope of this aspect, the first predetermined distance is greater than the second predetermined distance. Also, the first predetermined distance is less than the second predetermined distance.

Other aspects and features and combinations of them can be expressed as methods, apparatus, systems, program products, means for performing functions, and in other ways.

Advantages and features will become apparent from the following description and claims.

DESCRIPTION

FIGS. 11A-C, 12 and 13A-C are cross sectional profiles of loudspeaker surrounds.

Figure 14:
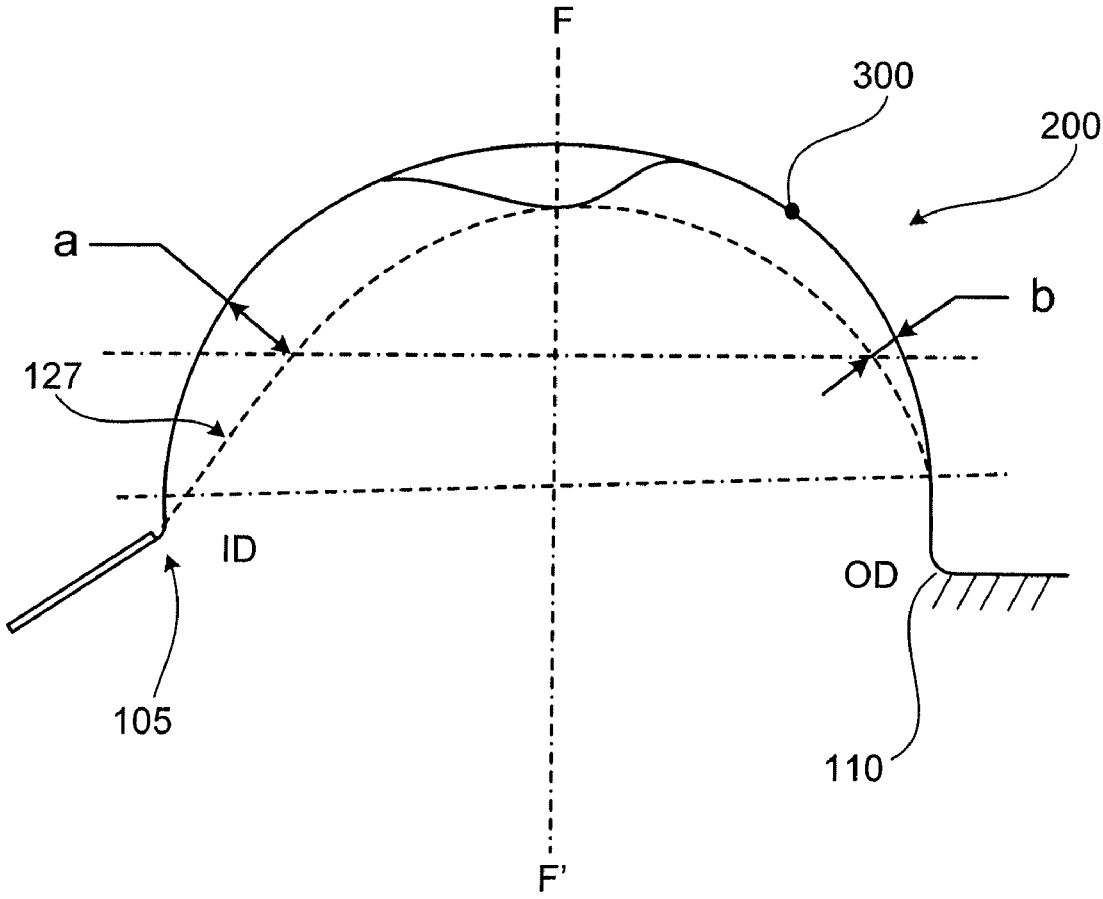
Figure 15A:
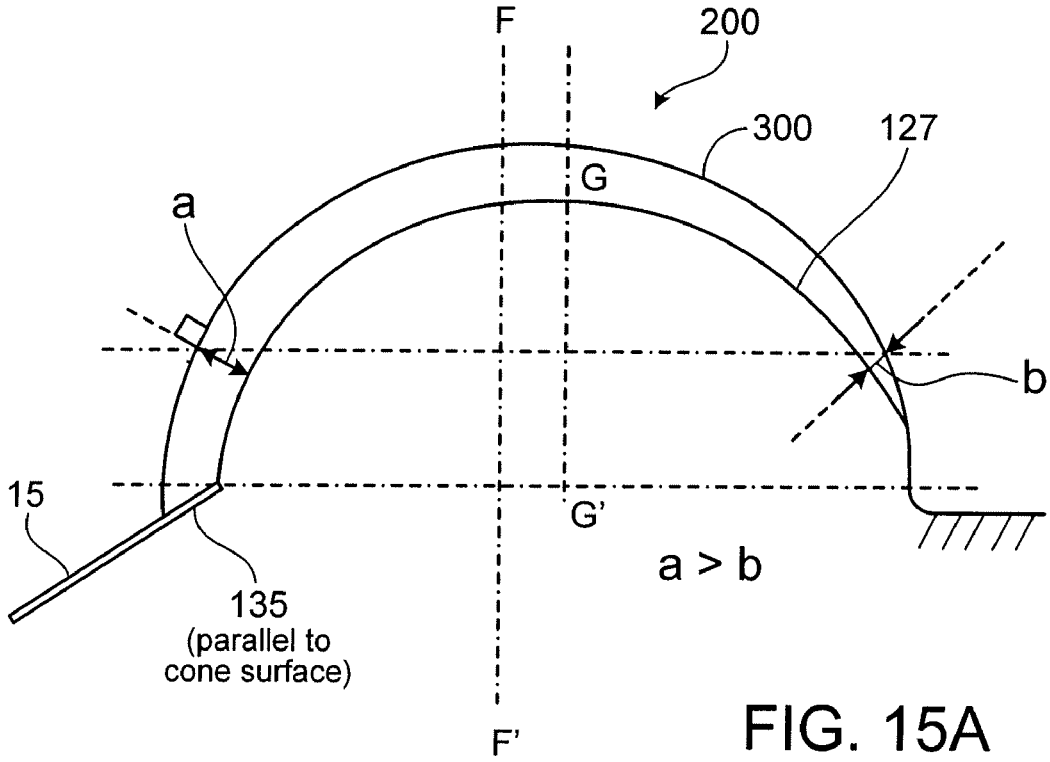
Figure 15B:
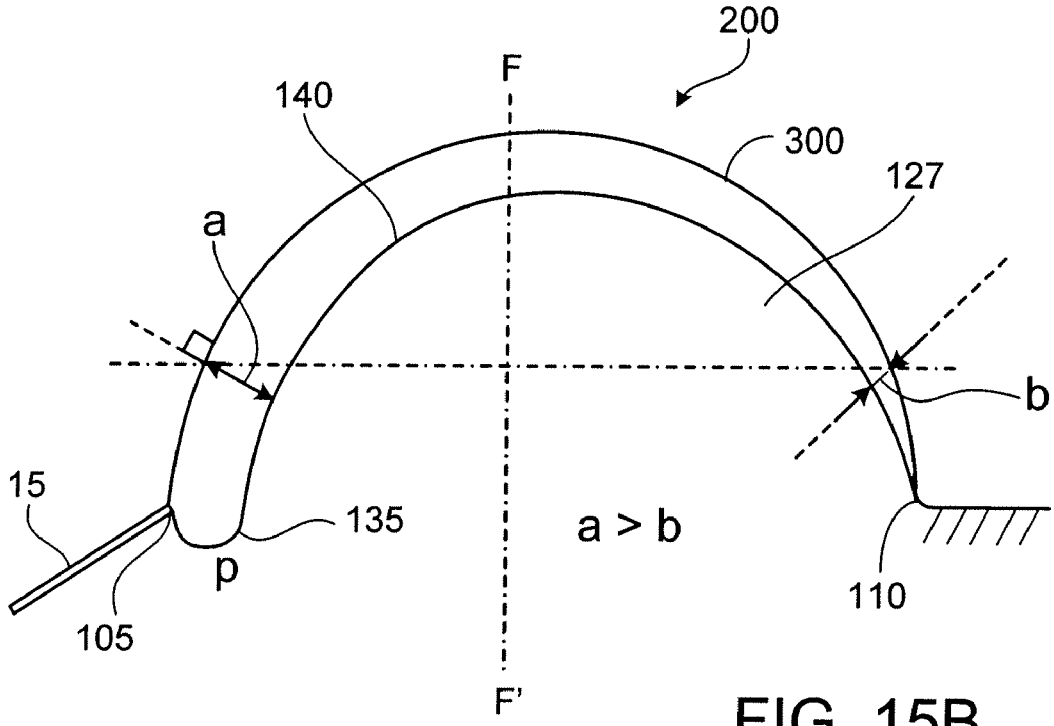

FIGS. 14 and 15A-B are profiles of asymmetrical grooves.

Figure 16A:
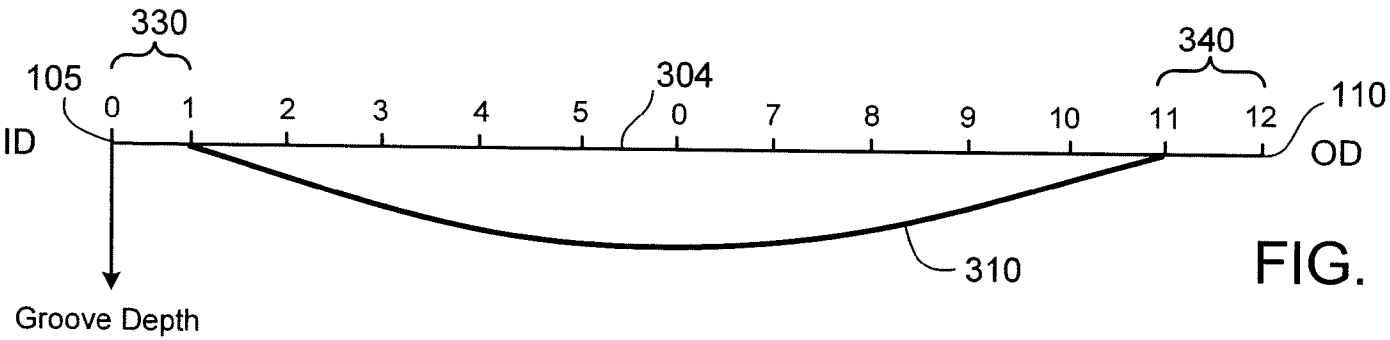
Figure 16B:
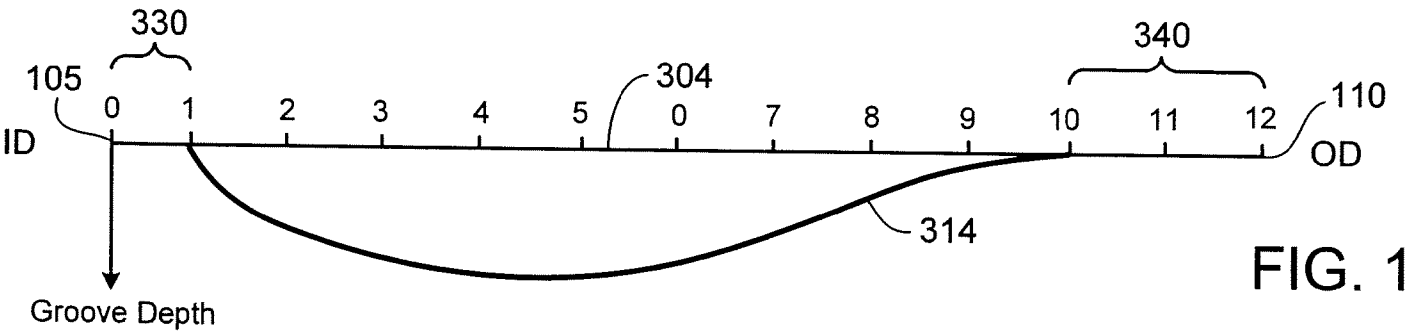
Figure 16C:
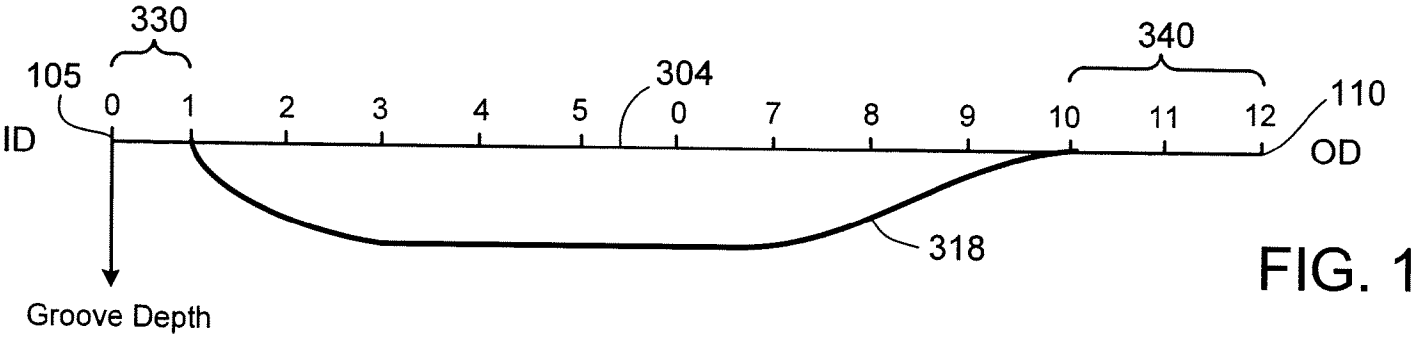
Figure 17:
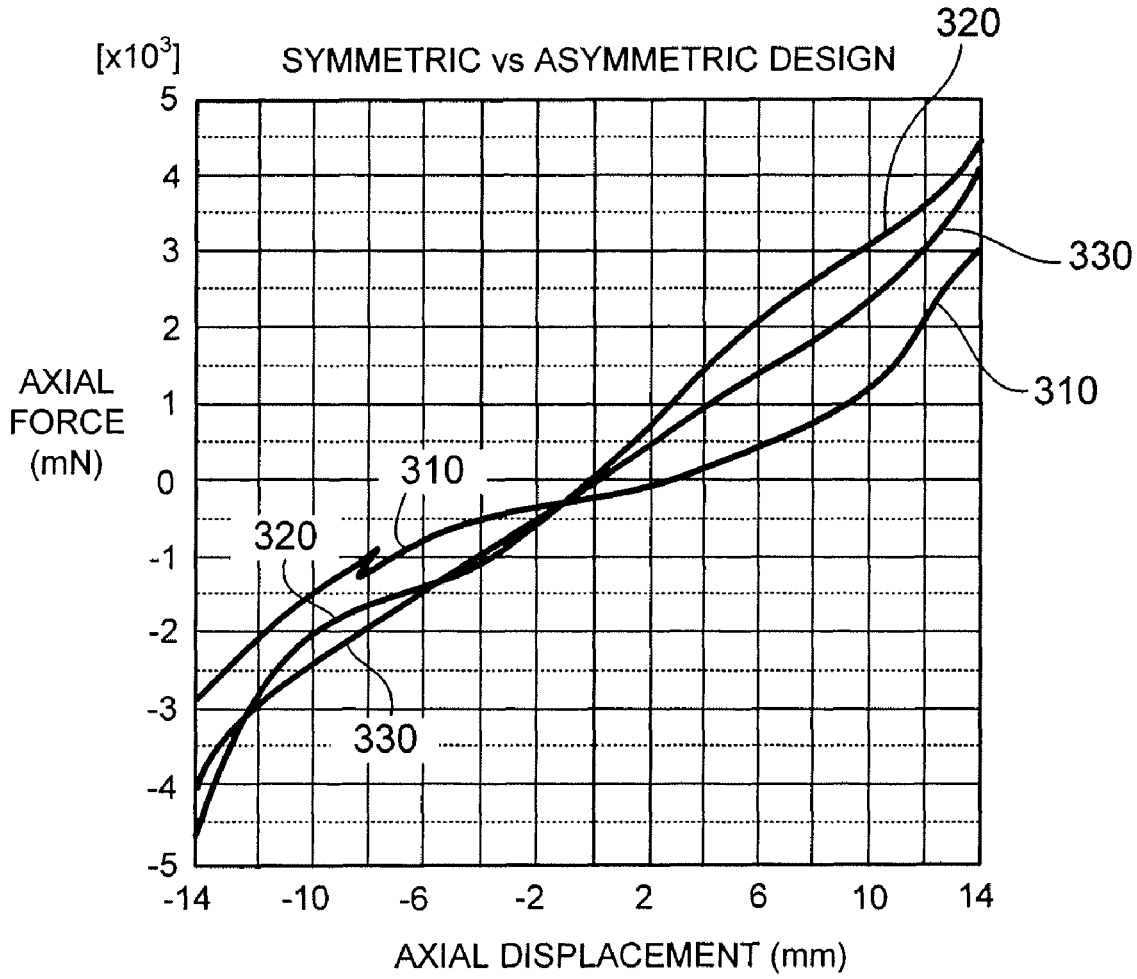

FIGS. 16A-C are graphical depictions of groove depth along a radial section of a surround FIG. 17 is a graphical depiction of axial force versus displacement of various loudspeaker surrounds.

Figure 1:
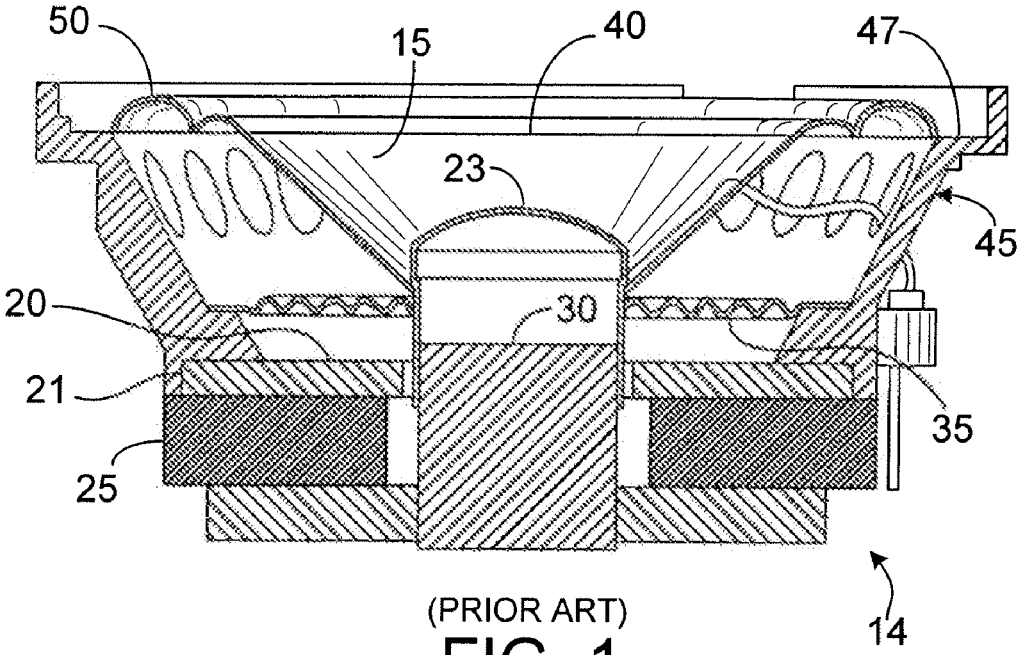
(PRIOR ART) FIG. 1
FIG. 1 is a sectional view of a loudspeaker.
Figure 2A:
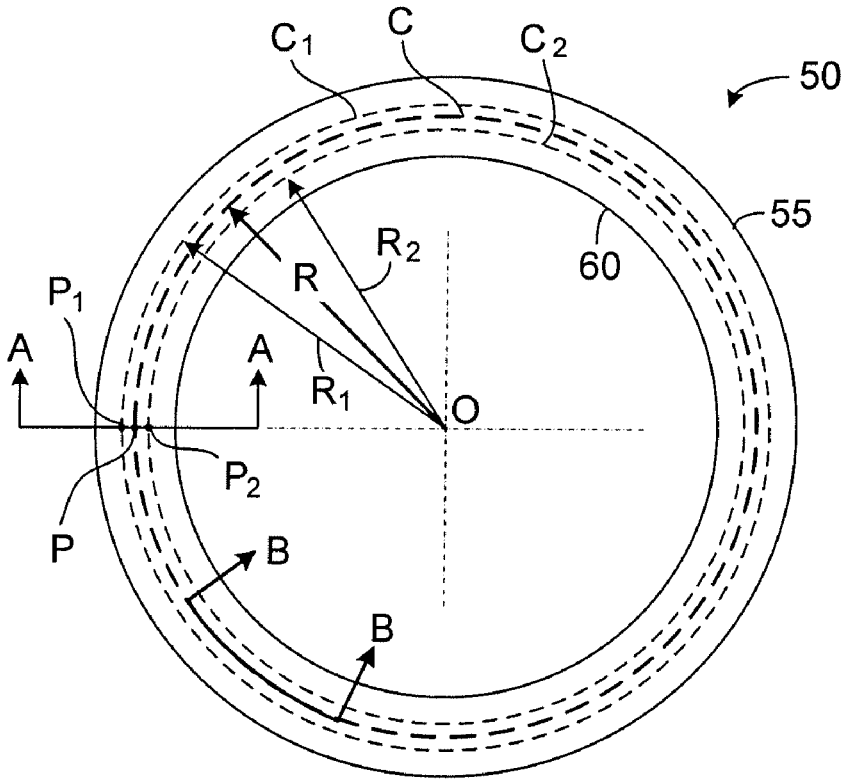
(PRIOR ART) FIG. 2A
FIG. 2 is a schematic plan view of a loudspeaker surround suspension element.
Figure 3:
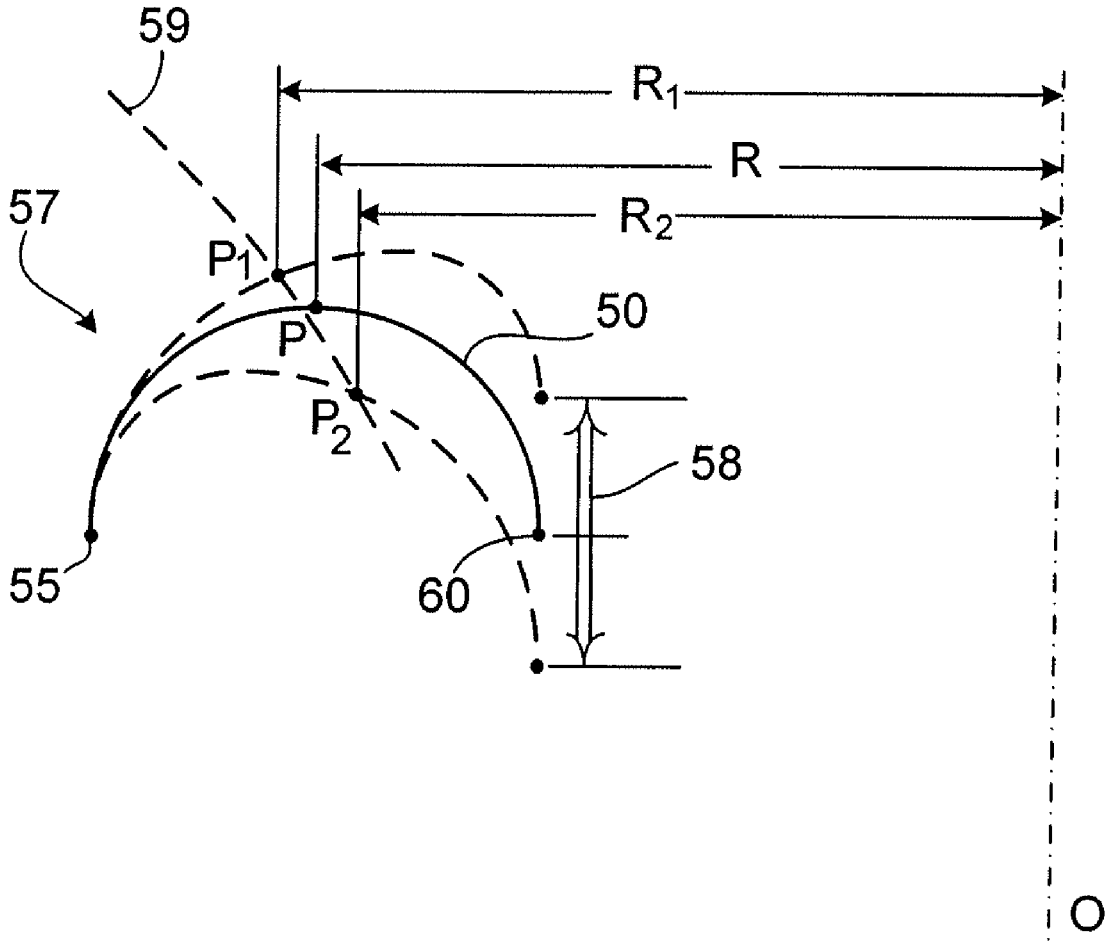
(PRIOR ART) FIG. 3
FIG. 3 is a cross-sectional view taken along line A-A in FIG. 2.
Figure 4:
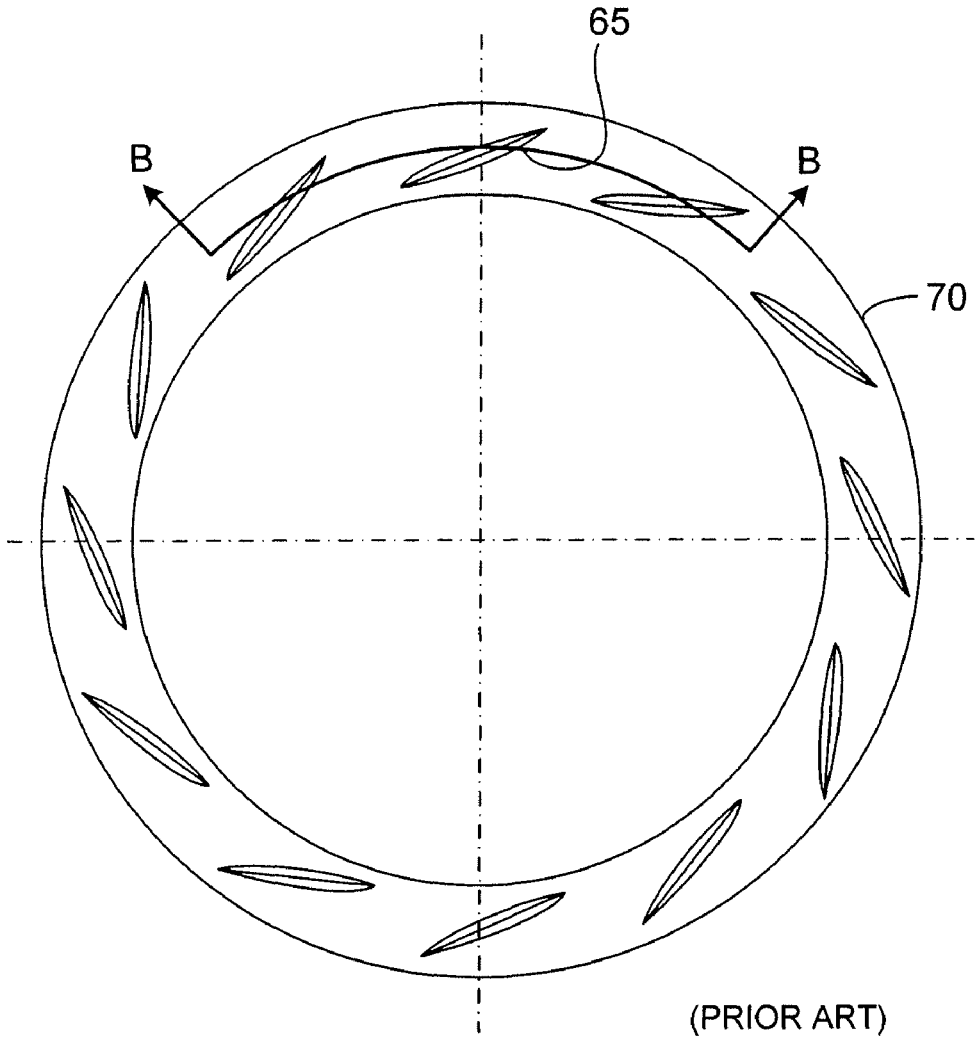
(PRIOR ART) FIG. 4
FIG. 4 is a schematic plan view of an alternative loudspeaker surround suspension element.
Figure 5:
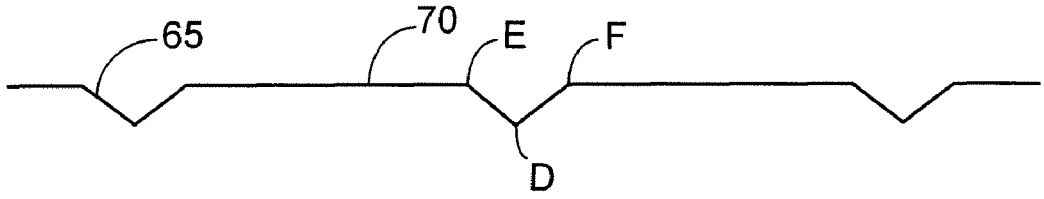
(PRIOR ART) FIG. 5
FIG. 5 is a cross-sectional view taken along line B-B in FIG. 2.
Figure 6A:
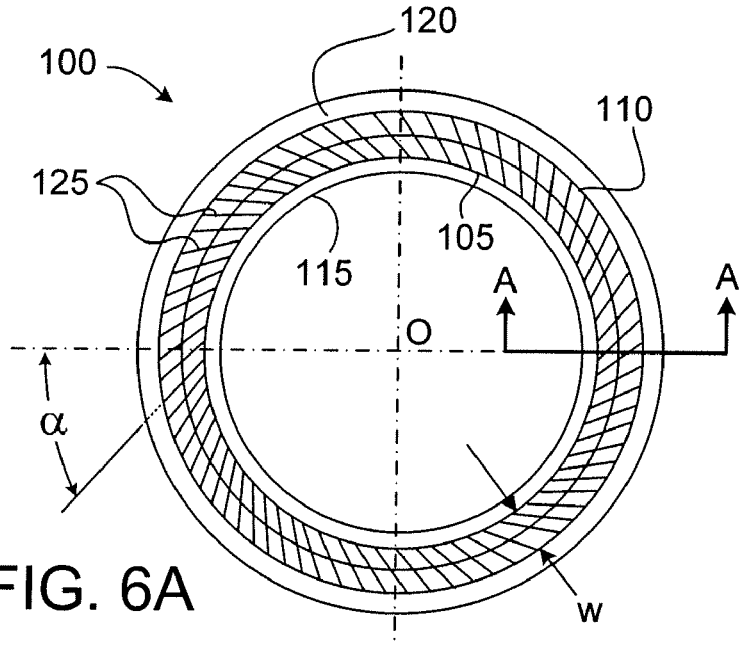
FIG. 6A is a plan view of a loudspeaker surround suspension element.
Figure 6B:
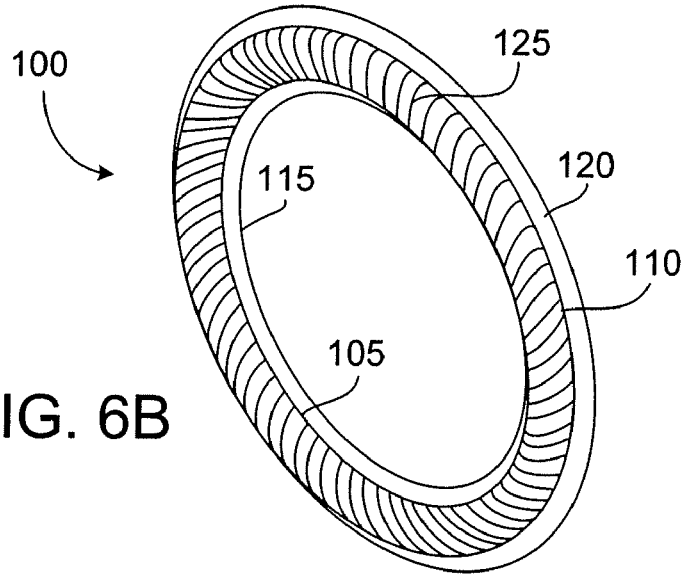
FIG. 6B is a perspective view of the surround suspension element of FIG. 6A.
Figure 6C:
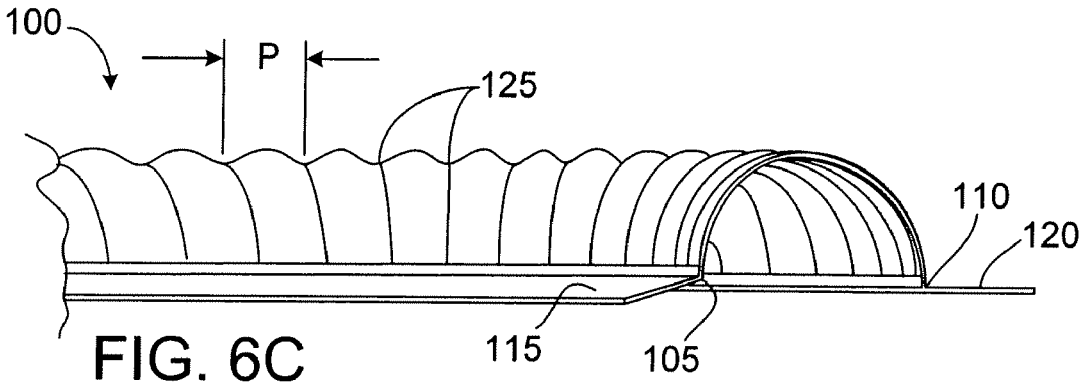
FIG. 6C is a perspective cross-sectional view taken along line A-A of FIG. 6A.

Referring now to FIGS. 6A-C, a semi-toroidal surround suspension element 100 is centered about an origin O and includes an inner circumferential border 105 and an outer circumferential border 110, separated by a radial width, W. In some examples, the surround 100 includes an inner attachment flange 115 extending radially inward from the inner circumferential border 105 and an outer attachment flange 120 extending radially outward from the outer circumferential border 110 for connection to the cone 15 and basket 45, respectively.

The surround 100 in FIGS. 6A-C is shown as having only a single convolution, i.e., one cycle of a repeating structure, where the structure is typically comprised of concatenated sections of arcs. In some examples, the surround 100 has multiple convolutions spanning the width W.

Figure 7:
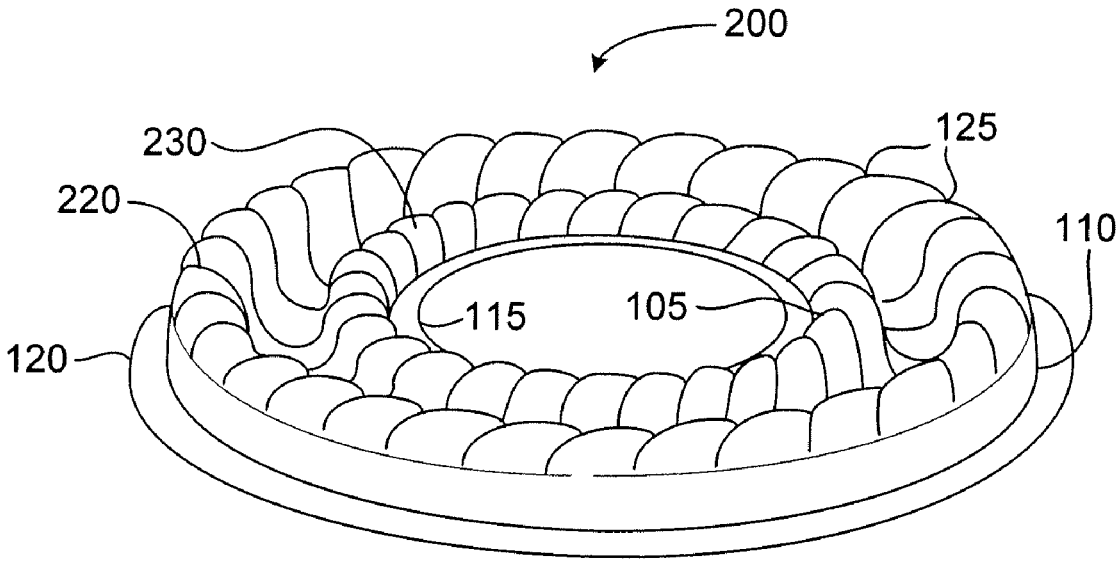
FIG. 7 is a perspective view of a loudspeaker spider suspension element.

The description of the surround 100 and its behavior is also generalized to include other suspension elements in a loudspeaker apparatus, such as, for example, loudspeaker spiders. In some examples, loudspeaker spiders also include multiple convolutions. An example of a loudspeaker spider 200 is shown in FIG. 7. The spider 200 has two convolutions 220, 230. In some surround or spider implementations, few or more convolutions, or portions of convolutions, are used.

Although surround 100 in FIGS. 6A-C is depicted as a semi-toroidal section, other less axially symmetrical shapes for attachment to non-circular cones, e.g., elliptical, racetrack, or other non-circular shapes, can be used as the surround 100.

As shown, the surround 100 includes a series of grooves 125, generally extending from the inner circumferential border 105 to the outer circumferential border 110 at an angle, alpha, to the radial direction, or more generally, at an angle to the normal of the inner circumferential border 105. Typically, the angle, alpha, is measured at a point in a groove 125 closest to the inner circumferential border 105 as described in further detail below.

In some examples, the grooves 125 do not extend along the entire width W, but extend over only a portion of the width. Although, for convenience, the grooves 125 shown in the plan view of FIG. 6A are depicted as straight lines having no width, the lines generally depict groove paths, i.e., the locii of the lowest points in the grooves 125.

As shown in FIG. 6C, adjacent grooves 125 are separated by a pitch distance P. The pitch distance P is generally described along a circumferential path taken at a predetermined radial length from the origin, O. For convenience, the pitch distance is defined at a midpoint along a radial line extending from the inner circumferential border 105 to the outer circumferential border 110 of the surround 100.

Figure 8A:
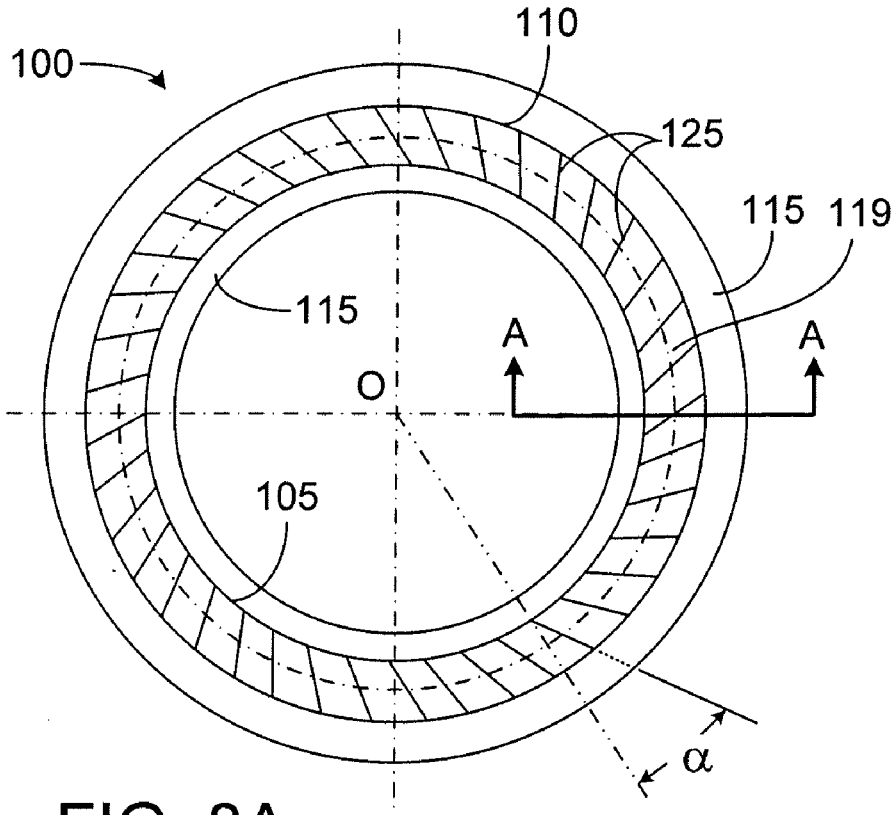
FIG. 8A is a plan view of a loudspeaker surround suspension element.
Figure 8B:
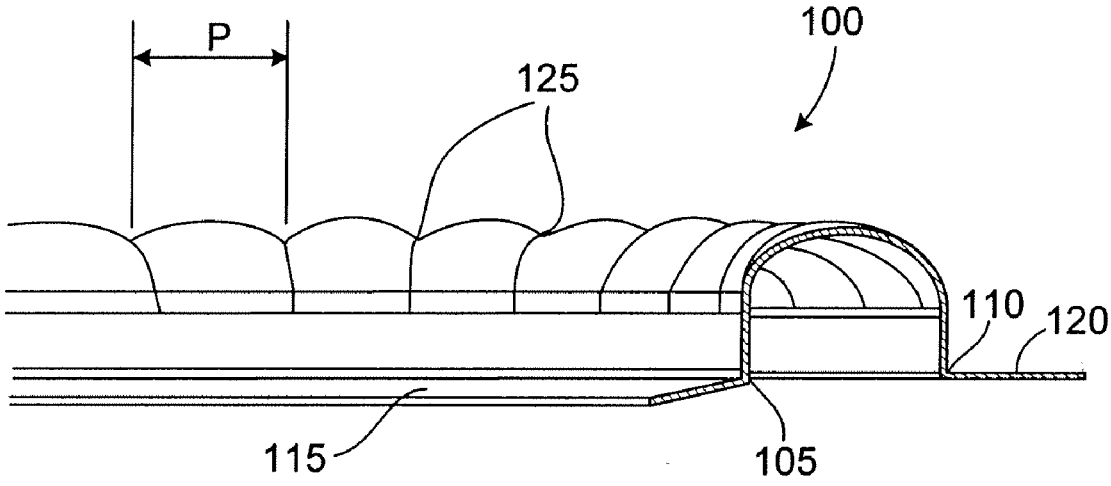
FIG. 8B is a perspective cross-sectional view taken along line A-A of FIG. 8A.

An alternative example of a surround suspension element 100 is shown in FIGS. 8A and 8B. The surround 100 shown in FIGS. 8A and 8B has fewer grooves 125 and a larger pitch distance P than in FIGS. 6A-C. Various examples of suspension elements use arbitrary pitch distances, P.

In some examples, the pitch distance is uniform for all successive pairs of grooves 125 along a circumferential distance, i.e., an arbitrary path traced along a circumference of the surround 100. As shown in FIG. 8A, in some examples, the circumferential distance is measured along a path traced by a midline 119 of the surround 100. In some examples, the pitch distance varies over the circumferential distance.

In some implementations, the pitch distance between successive peaks is at least about 4 times greater than the average height, A of the peaks. Accordingly, the average height of the peaks is between about 0.02 inch (0.050 cm) and 0.10 inch (0.25 cm) and the pitch distance is between about 0.15 inch (0.38 cm) and about 0.6 inch (1.52 cm)

Figure 9:
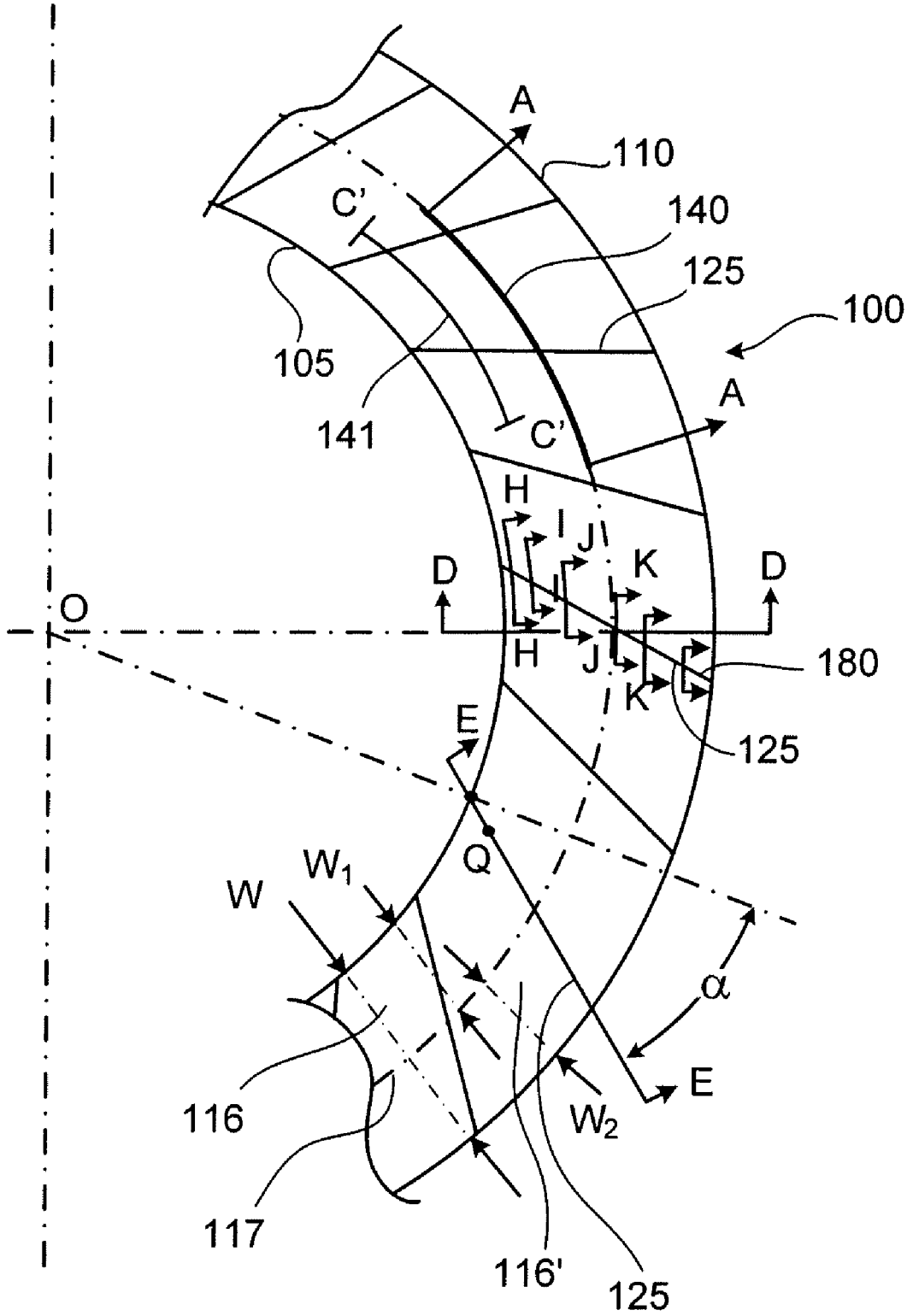
FIG. 9 is a partial schematic plan view of a loudspeaker surround.

FIG. 9 is a portion of the surround 100. As described above, alpha, is the angle between a groove path, i.e., the trace of the groove 125 in plan view, and a normal to the inner circumferential border 105 of the surround 100. In some examples, alpha varies over a wide range. For examples where the groove path in plan view traverses a substantially straight line from the inner circumferential border 105 to the outer circumferential border 110, the angle, alpha, of the groove path typically ranges from 30 to 60 degrees (or −30 to −60 degrees).

In some examples, alpha ranges from 10 to 80 degrees (or −10 to −80 degrees). Negative angles of alpha refer to grooves that incline in a direction that is opposite to the radial direction (or opposite to the normal to the inner circumferential border 105).

A groove path of a groove 125 can be straight, curved or straight for at least a potion of the groove path, and curved for at least another portion of the groove path. Accordingly, the radius of curvature along a groove path can be infinite, i.e. the groove path is a straight line, a finite constant, or smoothly or otherwise varying. For examples with a finite constant, or smoothly or otherwise varying groove curvature, alpha varies generally from 0 to 90 degrees along the groove path.

A groove path of a groove 125 typically traverses a plurality of circumferential portions, e.g., circumferential portions 116, 116' (generally 116) having widths W1 and W2, respectively, and at least one circumferential transition region, e.g., transition region 117. The angle of orientation of each circumferential portion 116, where the angle of orientation is described as the angle between a line through the portion at a point closest to the inner circumferential border 105, and a normal to the inner circumferential edge 105 that intersects the closest point, is chosen arbitrarily. In addition, the radius of curvature of the groove path along a circumferential portion 116 varies over the portion.

The transition region 117 smoothly join the ends of circumferential portions 116. The transition region 117 includes an inflection point at locations where a radius of curvature at the end of one circumferential portion and a radius of curvature at the beginning of another circumferential portion to which the circumferential portion is joined have opposite signs. The number of inflection points in a groove path of a groove 125 is typically arbitrarily chosen.

Figure 10:
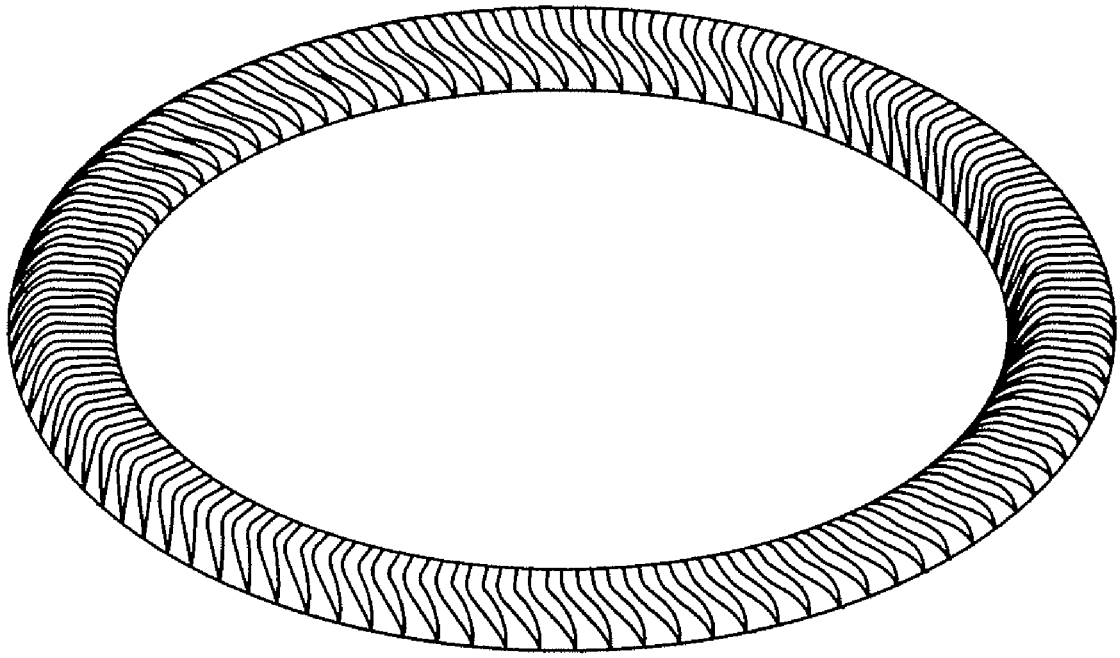
FIG. 10 shows a perspective view of an alternative loudspeaker surround.

An example having two transition regions and three circumferential portions, with inflection points in each transition region, is shown in FIG. 10. The angle of orientation of the middle portion of the groove path, where the middle portion traverses the middle portion of the width, W from the inner circumferential border 105 to the outer circumferential border 110 of the surround 100, is smaller than the angles of the first and third portions.

In some examples, the value of the groove angle, alpha, for a set of grooves can be different from or reversed in sign with respect to, another set of grooves. For example, in some implementations, the angle can be positive 35 degrees for one set and negative 40 for another set.

Figure 11A:
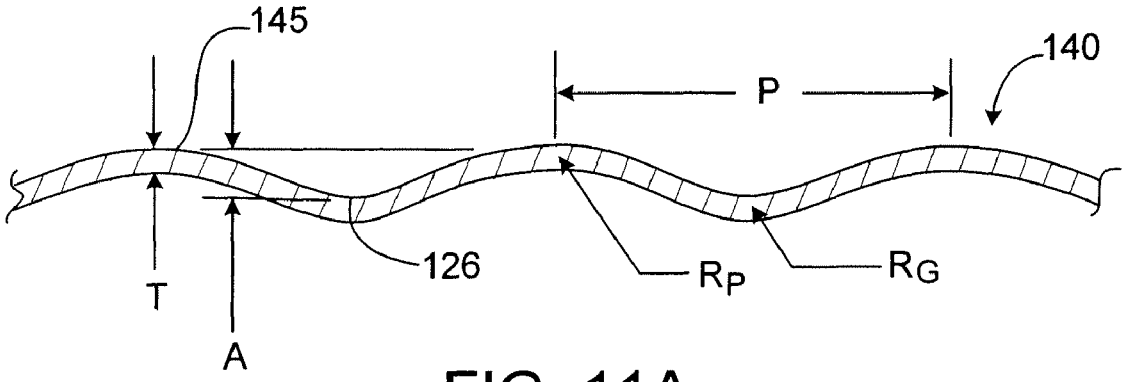

FIG. 11A is a circumferential section 140 taken along C-C of FIG. 9. In some examples, the circumferential section 140 is taken along a midsection of the width W of the surround 100. As shown, in some examples, the grooves 125 and sections between the grooves 125 form an undulating surface on the surround 100 along a circumferential direction. In some examples, the undulating surface on the surround 100 is continuously undulating.

Although the section 140 is shown as being circular (with respect to center O in FIG. 9), non-circular circumferential sections are also used. In some examples, the section 140 is taken at a constant normal distance to the inner circumferential border 105 of the surround 100. Accordingly, for a surround 100 having a circular geometry, the section 140 taken along C-C traces out a circle.

In some examples, for surrounds having non-circular geometries, a similar section 140 is also generally taken at a constant normal distance from the inner circumferential border 105. However, in such examples, the path traced around the surround 100 would no longer be circular. For convenience, in this description, circumferential sections include both circular and non circular surround geometries, where the section is taken at a constant normal distance from the inner circumferential border 105.

Peaks 145 separate adjacent dips 126 along the section 140. The dips 126 in the section 140 are typically formed by the grooves 125 that run across the span, or width of the surround 100. The radius of curvature of a peak 145 is given by $R_P$. In general, the radius of curvature of a groove is given by $R_G$. Accordingly, in the circumferential section 140, the radius of curvature of the dip 126 is the value of $R_G$ measured at the section 140.

In some examples, P=0.178", $R_P$=0.141", $R_G$=0.050", A=0.022", and T=0.010", where A is the depth of the dip 126, T is the material thickness of the surround 100, and P is the pitch distance between successive peaks (or dips) as described above.

The radii of curvature for the peak 145 and groove 125 ($R_P$ and $R_G$) are generally taken at the local maxima and local minima of the section 140. Also, the radii are measured at the mid-section of the surround 100. In some examples, the radii of curvature are measured elsewhere, such as, for example, along a top or bottom surface of the surround 100.

Typically, the value of $R_G$ is obtained at a point along the groove 125 with maximum depth, and the value of $R_P$ is obtained at a point where the peak 145 has maximum height. In some examples, the section 140 of the surround 100 has a continuous curvature over its entire length. In such examples, the section 140 is typically free of flat areas, e.g., the circumferential section of FIG. 11A.

In some examples, while the section 140 has a continuous curvature, a section 141 taken along, for example, C'-C' in FIG. 9, at a predetermined distance from section 140 does not have a continuous curvature. Alternatively, in some examples, section 141 taken along, for example, C'-C', can have a continuous curvature, but section 140 does not have a continuous curvature.

In some examples, the properties of continuous curvature can be emulated using piecewise linear approximation, generated by sufficiently small length linear segments. As the length of each linear segment in the approximation decreases, the behavior approaches that of a continuous curve. In some implementations, portions of sections 140, 141 are continuously curved while other portions of sections 140, 141 are piecewise linear.

In some examples, $R_P$ is greater than $R_G$. In some examples, the section 140 is generally approximated by an ordinary cycloid, where $R_P$ is unequal to $R_G$. In some examples, the section 140 is continuously curvilinear and does not include a constant pitch, P, between successive peaks.

Figure 13A:
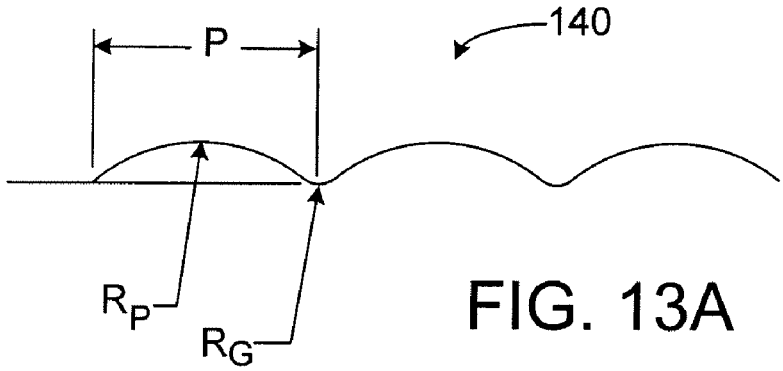
Figure 13B:
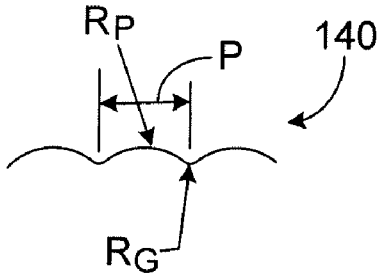
Figure 13C:
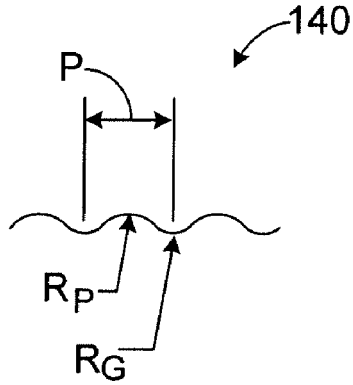

In some implementations, the ratio of radius $R_P$ to radius $R_G$, ($R_P/R_G$) of section 140 is less than about 10 as shown in FIGS. 13A-C. FIG. 13A shows a section 140 where $R_P/R_G$ is 8.8. In some implementations, $R_P/R_G$ is less than about 5. In some implementations, $R_P/R_G$ is less than about 3.

FIG. 13B shows a section 140 where $R_P/R_G$ is 2.8. FIG. 13C shows a section 140 where $R_P/R_G$ is about 1.2. Implementations are also possible where the ratio $R_P/R_G$ is less than one.

In general, both radii, $R_P$, $R_G$ are at least about three times greater than the material thickness, T, of the surround 100. $R_P$, $R_G$ should also generally be less than infinity, e.g., not flat, with the exception of a piecewise linear approximation.

Figure 11B:
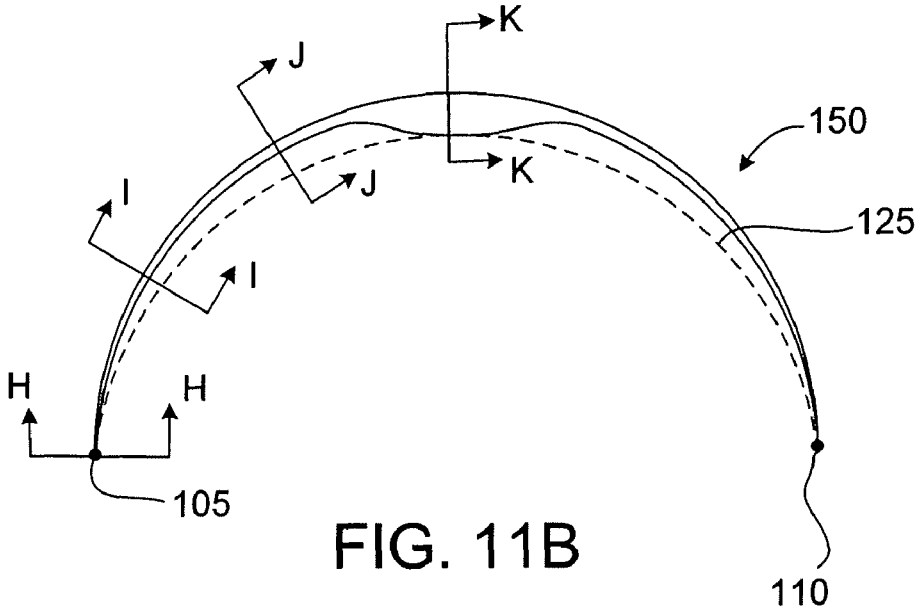

FIG. 11B is a radial section 150 taken along D-D of FIG. 9. As shown, the section 150 is typically taken normal to the inner circumferential border 105 of the surround 100. Although a circular radial section is shown, non-circular sections can also be used. Accordingly, for a surround 100 having a circular geometry, the section 150 coincides with a radial direction.

In some examples, a similar radial section for a surround with a non-circular geometry is generally taken normal to the inner circumferential border 105. However, in these examples, the section 150 no longer corresponds to a radius originating from the center, O. For convenience, in this description, radial sections include both circular and non circular surround geometries, where the section is taken at a normal to the inner circumferential border 105.

Figure 12:
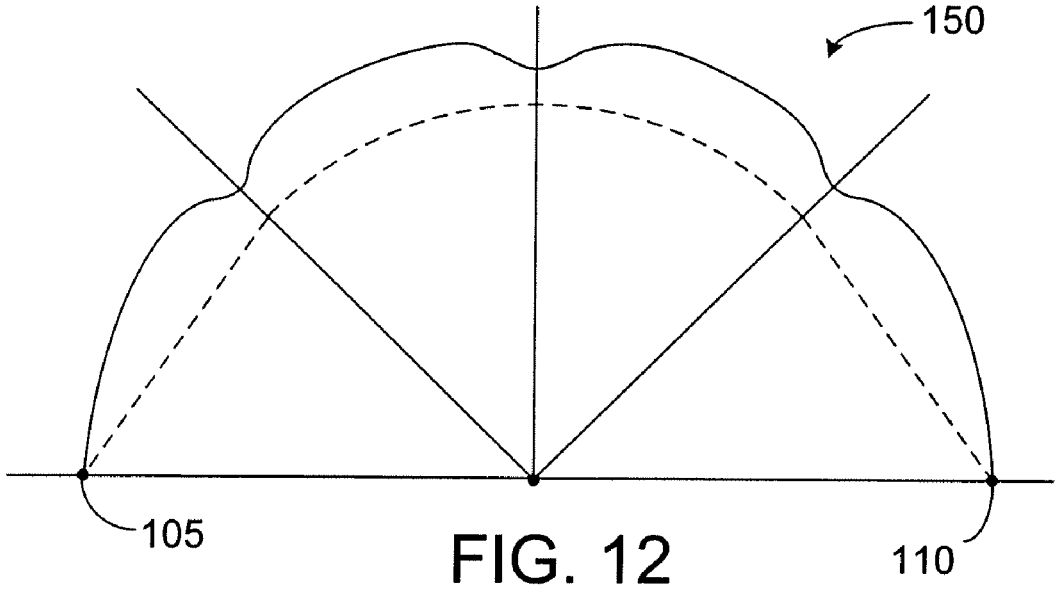

In some examples, the section 150 also includes nominal shapes other than half-circular, e.g., a typical half roll. For example, as shown in FIG. 12, the radial section of the surround 100 includes undulations along nominally circular arcs or arc sections. In some examples (not shown), the section 150 includes concatenated sections of circular arcs, as would be typical of multi-roll surrounds or spiders. In some implementations, the radial section includes a typical half roll, but with the side walls deepened to increase an effective roll height. The radial sections can be used in toroidal shaped surrounds, e.g., surround 100 in FIGS. 6A-6C, or other less axially symmetrical shapes, e.g. elliptical, oval or racetrack, or other non-circular shapes.

Figure 11C:
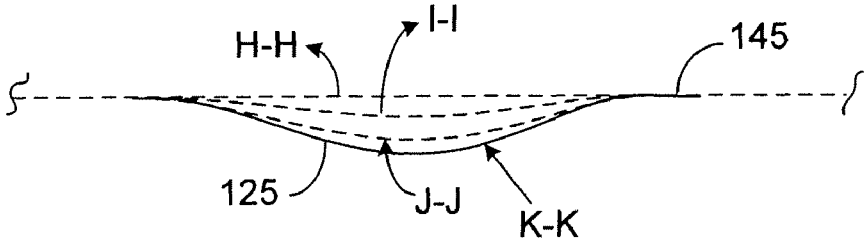

FIG. 11C describes circumferential profiles of a representative groove 125 corresponding to section lines H-H, I-I, J-J, and K-K of FIG. 11B.

A groove 125 can have a groove depth that varies symmetrically or asymmetrically along the length of the groove 125. A symmetrical groove typically has a symmetrically varying groove depth about a predetermined axis. Accordingly, the bottom of the groove traces a symmetrical curve about the axis. Accordingly, in some examples, the groove depth substantially at or near the inner circumferential border 105 is generally equal to the groove depth substantially at or near the outer circumferential border 110. A loudspeaker suspension having symmetric grooves is disclosed in U.S. application Ser. No. 10/993,996, entitled "LOUDSPEAKER SUSPENSION," and incorporated herein in its entirety by reference.

Typically, the bottom of the groove 125 follows a curvature of a principal surface of the surround 100, but traces a path having a larger radius of curvature than the principal surface. For example, in a half-roll surround with symmetric grooves, the bottom of each of the grooves generally follows the curvature of the half-roll surround surface, but with a larger radius of curvature.

When the surround 100 moves axially, the inner circumferential border 105 moves substantially along with the cone, while the outer circumferential border 110 remains substantially stationary. As a result, during movement of the surround 100, a point Q (FIG. 9) on the surround 100 between the inner circumferential border 105 and the outer circumferential border 110 experiences hoop stress.

Since portions of the half-roll near the inner circumferential border 105 moves the most in a radial direction, they experience substantially higher hoop strain than the rest of the surround 100. Consequently, these portions of the surround 100 near the inner circumferential border 105 need to absorb more strain than the portions of the surround 100 near the outer circumferential border 110.

FIG. 14 is a section of an asymmetric groove 127 taken along a radial direction, e.g., radial section D-D shown in FIG. 9. As shown, the dashed curve represents a profile of the groove 127 that is traced by rotating each point on the groove path of the groove 127 about an axis of the half-roll until they intersect with the plane D-D. In the asymmetrical groove 127, the groove depth varies asymmetrically about a central axis. Accordingly, the bottom of the groove 127 traces an asymmetrical curve about the central axis.

Typically, in the groove 127, the groove depth at or near the inner circumferential border 105 is different from the groove depth at or near the outer circumferential border 110. For example, a groove depth, "a" at or near the inner circumferential border 105 is generally greater than a groove depth, "b" at or near the outer circumferential border 110.

A half-roll curve 300 represents a trace projected by the principal surface of the surround 100 on a plane parallel to radial section D-D. In some examples, the half-roll curve 300 is substantially symmetrical about an axis, FF', and has a predetermined radii of curvature. In some examples, the half-roll curve 300 is skewed, i.e., the half-roll curve 300 has substantially different radii of curvature on either side of the axis, FF'.

In some examples, the half-roll curve 300 is divided into a plurality of portions, each portion having a substantially different radius of curvature. In some examples, the half-roll curve 300 describes a curve having a continuously changing radius of curvature. For example, the half-roll curve 300 can describe a parabolic curve.

In some examples, the depth of the asymmetric groove 127 varies as a function of distance along the bottom of the groove 127. In some implementations, the depth of the asymmetric groove 127 remains substantially constant over a large portion of the width W of the surround 100. In some implementations, the depth of the asymmetric groove 127 has a plurality of local maxima and minima along the groove path, forming undulations in the bottom of the groove 125.

The bottom of the asymmetric groove 127 can define a curve having any one of at least a positive, negative, infinite, or variable, e.g., continuous changing, radius of curvature. For example, in one implementation, the bottom of the asymmetric groove 127 describes a curve having a continuously changing radius of curvature, e.g., a parabolic curve.

The bottom of the asymmetric groove 127 can also define a curve having a plurality of sections, each of the plurality of sections having a different radii of curvature. In some examples, at least one of the plurality of sections has an infinite curvature.

FIG. 15A is a section of one implementation of the asymmetric groove 127. In this implementation, the bottom of the asymmetric groove 127 has two portions 135, 140. As shown, the groove depth, "a," at or near the inner circumferential border 105 is generally greater than the groove depth, "b," at or near the outer circumferential border 110.

The first portion 135 of the bottom of the asymmetric groove 127 runs parallel to a surface of the cone 15 for a distance, "s." Accordingly, the first portion 135 has an infinite radius of curvature. The second portion 140 of the bottom of the asymmetric groove 127 traces a curve of a predetermined radius of curvature. In some implementations (not shown), the first portion 135 traces a substantially straight line that is at a predetermined angle to the surface of the cone 15.

In some implementations, the groove depth defined by the bottom of the asymmetric groove 127 is deeper at some regions than at other regions. For example, the first portion 135 has a negative radius of curvature as shown in FIG. 15B. Alternatively, the first portion 135 is at a predetermined angle described in a direction that is substantially away from the half-roll curve 300. As a result, in these examples, the groove depth defined by the first portion 135 is deeper than the groove depth defined by the second portion 140. In some implementations, the groove depth 135 defined at the intersection region (or transition region) of the first portion 135 and the second portion 140 is substantially deeper than the groove depths defined in the remaining portions of 135 and 140.

In some examples, the second portion 140 of the bottom of the asymmetric groove 127 traces a curve that is substantially symmetrical about an axis GG' (FIG. 15A). In some examples, the second portion 140 traces a curve that is not symmetrical about any axis, e.g., the second portion 140 has different radii of curvature on either side of the axis GG'.

FIGS. 16A-C show graphical representations of variations of the groove depth along a half-roll of a surround 100 for exemplary symmetrical and asymmetrical grooves. The straight lines 304 in FIGS. 16A-C, each represent a distance along a groove, measured along a half-roll, of the surround 100, from the inner circumferential border 105 to the outer circumferential border 110. The lines 304 are each graduated for convenience by substantially equidistant markers that are numbered, 1, 2, 3, . . . 12. As shown, the bottom of each of the grooves 310, 314, and 318 begin at a point indicated by the marker 1, and end at either a point indicated by the marker 11 (FIG. 16A), or a point indicated by the marker 10 (FIGS. 16B-C).

On each line 304, the point indicated by the marker 3, and the point indicated by the marker 9, are located at substantially the same distance from the inner circumferential border 105, and the outer circumferential border 110, respectively.

In FIGS. 16A-C, the vertical distance from the line 304 (the half-roll) to the bottom of the grooves 310, 314, and 318, respectively, represent the groove depth for the grooves.

Referring now to FIG. 16A, for a symmetrical groove 310, the groove depth at the point indicated by the marker 3, is substantially equal to the groove depth at the point indicated by the marker 9. In addition, in some examples, the point indicated by the marker 3, and the point indicated by the marker 9, are located at substantially the same distance from the point having the deepest groove depth, indicated by the marker 6.

Referring to FIGS. 16B-C, for an asymmetrical groove 314, the groove depth at a point indicated by the marker 3 is substantially different from the groove depth at the point indicated by the marker 9. As shown, the groove depth at the point indicated by the marker 3 is greater than the groove depth at the point indicated by the marker 9. In some implementations, the groove depth at the point indicated by the marker 3 can be less than the groove depth at the point indicated by the marker 9.

In some examples, the bottom of the grooves 310, 314, and 318 do not meet the half-roll, i.e., line 304, at points that are equidistant from the inner circumferential border 105, and the outer circumferential border 110, respectively. For example, as shown, in FIG. 16A, for a symmetrical groove, the distance 330 is substantially the same as the distance 340. In contrast, as shown in FIGS. 16B-C, for asymmetrical grooves 314, 318, the distance 330 is substantially different from the distance 340. In some implementations, the distance 330 can be greater or less than the distance 340.

In FIGS. 16B-C, the asymmetrical grooves 314, 318, meet the half-roll at a point indicated by the marker 10. The grooves 314, 318 also meet the half-roll at the point indicated by the marker 1. Accordingly, there is no groove depth over the distance 330 from the inner circumferential border 105 to the point indicated by the marker 1, and the distance 340 from the point indicated by the marker 10 to the point indicated by the marker 12 (the outer circumferential border 110).

Also, in general, a thickness, i.e., a material depth of the surround 100, can vary from the inner circumferential border 105 to the outer circumferential border 110, and also, in a circumferential direction. In this regard, in some examples, the thickness of the surround 100 can vary uniformly or non-uniformly from the inner circumferential border 105 to the outer circumferential border 110. In some examples, the thickness of the surround 100 can vary uniformly or non-uniformly along a circumferential direction.

For example, in some implementations, the thickness of the surround 100 at the outer circumferential border 105 is greater than the thickness in other portions of the surround 100. In some implementations, the thickness of the surround 100 at the inner circumferential border 105 and the outer circumferential border 110 is greater than the thickness of the surround 100 at other portions. In some examples, the thickness of the surround 100 at a mid-section portion is greater than the thickness of the surround 100 at other portions.

In general, an axial force is applied to the surround 100 in a direction that is substantially along a primary direction of motion of the cone assembly (typically the axial direction). The axial force causes an axial displacement of the surround 100. In response, the surround 100 provides a reaction force to balance the effect of the axial force and restore the surround 100 to its original configuration.

FIG. 17 shows graphical relationships between the axial force and axial displacement of a surround 100 having wide pitched grooves (curve 410), symmetric grooves (curve 420), and asymmetric grooves (curve 430). An example of a surround 100 having wide pitched grooves is described above in connection with FIGS. 8A-B. An example of a surround 100 having symmetric grooves is described in U.S. application Ser. No. 10/993,996, referenced above. Examples of a surround 100 having asymmetric grooves are described above in connection with FIGS. 14 and 15A-B.

Portions of the force-deflection curves 410, 420 and 430 are shown as extending in either direction of the origin along the displacement and force axes (positive and negative axial deflections of the surround 100).

In general, buckling is manifested as discontinuities or a dramatic loss of reaction force. In the curve 410 for a surround having wide pitched grooves, the onset of buckling is evidenced by a deviation from a generally linear relationship at only approximately 8 mm in axial deflection. In some examples, the curve 410 also exhibits discontinuities.

The curve 420 for a surround having symmetrical grooves depicts less buckling and stress concentrations. However, the curve 420 shows a low range of linearity and anti-symmetry with respect to the origin.

In contrast, the curve 430 for surround with asymmetrical grooves shows a high range of linearity and anti-symmetry with respect to the origin. In this regard, the curve 430 is smoother and has higher linear range than the curves 410 and 420. Further, a surround having asymmetrical grooves also further reduces stress concentrations and buckling, making it more durable.

Other embodiments are within the scope of the following claims.

For example, although the surround and the spider are typically distinct components, separate from the cone or diaphragm, one or both may be attached to the cone using adhesives, heat staking, ultrasonic welding, or other joining processes to form an assembly. In some implementations the surround may be formed integrally with a portion of or all of the cone. In the latter cases, the suspension structure has a virtual border even if not a discrete border.

One or more of the examples described above in connection with surrounds can also be used, in whole, or in part, in spiders, or other suspension elements of a loudspeaker, or a transducer.

What is claimed is:

1. A loudspeaker suspension, comprising:

a loudspeaker suspension structure having grooves, each extending from an inner circumferential border, to an outer circumferential border, at least one groove having a groove depth that varies asymmetrically from the inner circumferential border to the outer circumferential border.

2. The loudspeaker suspension of claim 1 in which the at least one groove has at least two substantially different groove depths.

3. The loudspeaker suspension of claim 1 in which the at least one groove has a first groove depth substantially near the inner circumferential border, and a second groove depth substantially near the outer circumferential border.

4. The loudspeaker suspension of claim 3, in which the first groove depth is substantially greater than the second groove depth.

5. The loudspeaker suspension of claim 1 in which the grooves are oriented at an angle with respect to a normal to the inner circumferential border.

6. The loudspeaker suspension of claim 1 in which the grooves span only a portion of the distance between the inner circumferential border and the outer circumferential border.

7. The loudspeaker suspension of claim 1 in which a profile of a circumferential section of the suspension structure has a continuous curvature.

8. The loudspeaker suspension of claim 7 in which the continuous curvature includes a series of peaks and dips and the radius of curvature of each of the peaks is greater than the radiuses of curvature of the adjacent dips.

9. The loudspeaker suspension of claim 7 in which the continuous curvature includes a series of peaks and dips and the radius of curvature of at least a portion of each of the peaks is less than the radiuses of curvature of the adjacent dips.

10. The loudspeaker suspension of claim 1 in which the suspension structure comprises a fractional portion of a toroid.

11. The loudspeaker suspension of claim 1 in which the suspension structure conforms to a rolled shape.

12. The loudspeaker suspension of claim 11 in which the rolled shape is rolled up.

13. The loudspeaker suspension of claim 11 in which the rolled shape is rolled down.

14. The loudspeaker suspension of claim 1 in which the rolled shape comprises two or more rolls between the inner circumferential border and the outer circumferential border.

15. The loudspeaker suspension of claim 1 in which the grooves have varying groove depths along a circumference of the suspension structure.

16. The loudspeaker suspension of claim 1 in which the grooves are spaced irregularly along a circumference of the suspension structure.

17. The loudspeaker suspension of claim 1 in which each of the grooves comprises a curve.

18. The loudspeaker suspension of claim 17 in which the curve begins at an angle to the normal to the inner circumferential border or the outer circumferential border.

19. The loudspeaker suspension of claim 17 in which the curve comprises sections.

20. The loudspeaker suspension of claim 19 in which the sections comprise straight sections.

21. The loudspeaker suspension of claim 19 in which the sections comprise curved sections.

22. The loudspeaker suspension of claim 19 in which the sections have respectively different angles with respect to a normal to the inner circumferential border.

23. The loudspeaker suspension of claim 19 in which the sections also comprises transition sections that smoothly join the straight or curved sections.

24. The loudspeaker suspension of claim 1 in which a bottom of a groove comprises of a plurality of portions, each portion having a substantially different radius of curvature.

25. The loudspeaker suspension of claim 1 in which the grooves are located in different convolutions of the suspension structure.

26. The loudspeaker suspension of claim 1 in which a thickness of the loudspeaker suspension structure varies from the inner circumferential border to the outer circumferential border.

27. The loudspeaker suspension of claim 1 in which a thickness of the loudspeaker suspension structure varies along a circumferential direction.

28. The loudspeaker suspension of claim 1 in which the suspension structure comprises a surround.

29. The loudspeaker suspension of claim 1 in which the suspension structure comprises a spider.

30. A loudspeaker suspension, comprising a loudspeaker suspension structure having an inner circumferential border, and an outer circumferential border, and grooves, each having a first groove depth substantially near the inner circumferential border and a second groove depth substantially near the outer circumferential border, the first groove depth being different from the second groove depth.

31. The loudspeaker suspension of claim 30 in which each of the grooves extend from the inner circumferential border to the outer circumferential border.

32. A loudspeaker suspension, comprising a loudspeaker suspension structure having an inner circumferential border, and an outer circumferential border, and at least one groove having a groove depth that varies asymmetrically along the length of the groove, a first end of the groove being at a first predetermined distance from the inner circumferential border, and a second end of the groove being at a second predetermined distance from the outer circumferential border.

33. The loudspeaker suspension, of claim 32 in which the first predetermined distance is greater than the second predetermined distance.

34. The loudspeaker suspension, of claim 32 in which the first predetermined distance is less than the second predetermined distance.

* * * * *